US005526004A

United States Patent [19]

Antipov et al.

[11] Patent Number: 5,526,004

[45] Date of Patent: Jun. 11, 1996

[54] FLAT STRIPLINE ANTENNA

[75] Inventors: A. N. Antipov; Z. L. Vinnitskiy; V. D. Dvouretchenskiy; I. V. Myagkov; A. Yu. Fedotov, all of Moscow, Russian Federation

[73] Assignee: International Anco, New York, N.Y.

[21] Appl. No.: 435,495

[22] Filed: May 5, 1995

Related U.S. Application Data

[63] Continuation-in-part of Ser. No. 207,939, Mar. 8, 1994, abandoned.

[51] Int. Cl.[6] ..... H01Q 1/38

[52] U.S. Cl. ..... 343/700 MS; 343/846; 343/775

[58] Field of Search ..... 343/700 MS, 731, 343/737, 775, 772, 786, 846; H01Q 1/38

[56] References Cited

U.S. PATENT DOCUMENTS

| | | | |
|---|---|---|---|
| 3,972,050 | 7/1976 | Kaloi | 343/846 |
| 3,995,277 | 11/1976 | Olyphant, Jr. | 343/846 |
| 4,521,781 | 6/1985 | Campi et al. | 343/700 MS |
| 4,644,361 | 2/1987 | Yokoyama | 343/700 MS |
| 4,933,679 | 6/1990 | Khronopulo et al. | 343/700 MS |

FOREIGN PATENT DOCUMENTS

| | | |
|---|---|---|
| 1730697 | 4/1992 | Russian Federation . |
| 2170051 | 1/1986 | United Kingdom . |

*Primary Examiner*—Donald T. Hajec
*Assistant Examiner*—Hoanganh Le
*Attorney, Agent, or Firm*—Pitts & Brittian

[57] ABSTRACT

An antenna (10) having a plurality of stripline antennas (12). Each stripline antenna (12) is comprised of a plurality of radiating elements (14). The plurality of stripline antennas (12) are arranged in a flat array. The shape of each radiating element (14) is prescribed by an exact mathematical expression whose dimensions are a function of the radiating wave length, characteristics of the directional pattern and the input resistance of the antenna (10). Electromagnetic energy is supplied via a rectangular waveguide (40) and arrives at the input ends of the stripline antennas (12) via an excitation device (20), a gradual junction (28) and a radial bend (30).

8 Claims, 6 Drawing Sheets

$$V_{ph} = C / \sqrt{E_{EFF}}$$

$V_{ph} = C/\sqrt{E_{EFF}}$

FLAT STRIPLINE ANTENNA

This is a continuation-in-part and discloses and claims subject matter disclosed in our earlier filed application Ser. No. 08/207,939 filed on Mar. 8, 1994, now abandoned.

TECHNICAL FIELD

The present invention relates to the field of flat stripline antennas. More particularly, the present invention relates to an antenna array of linear stripline antennas consisting of consecutively connected radiating elements.

BACKGROUND ART

In the field of microwave plane antennas, or flat antennas, it is well known that there are typically two types. The first type generally includes antennas with small electrical dimensions with respect to the wavelength. This type of antenna is distinguished by a wide-band. Antennas of the second type define a large electrical length and typically operate using a standing wave. This type of antenna is distinguished by a narrow band.

Other flat antennas have been developed to overcome problems in the art. Typical of these are those antennas disclosed in the following U.S. Patents:

| U.S. Pat. No. | Patentee(s) | Issue Date |
|---|---|---|
| 3,972,050 | C. M. Kaloi | July 22, 1976 |
| 3,995,277 | M. Olyphant, Jr. | Nov. 30, 1976 |
| 4,644,361 | Y. Yokoyama | Feb. 17, 1987 |
| 4,933,679 | Y. Khronopulo, et al. | June 12, 1990 |

and by T. Makinoto, et al., in UK Patent Application Number 2,170,051A, published Jul. 23, 1986. The antenna in accordance with the Yokoyama ('361) patent consists of unit rectangular elements with a fixed length (equal to one quarter of the wavelength) and a fixed width (equal to one half of a wavelength). The antenna in accordance with the Kaloi ('050) patent represents an antenna array formed from a plurality of radiating elements. The shape of the Kaloi elements is similar to the shape of the elements disclosed in the '361 patent. The device disclosed by Olyphant, Jr. ('277) is described as being provided with radiating elements which are significantly different from the present invention. The antennas described in the '679 patent issued to Khronopulo, et al. and in the UK patent ('051 A) issued to Makinoto, et al., each consist of a plurality of stripline antennas combined into an antenna array defined by a specific height above an integral metal base. Each stripline antenna is defined by a plurality of consecutively connected radiating elements. The radiating elements are each identical to the others. Each stripline antenna represents a section of an unbalanced stripline, with the configuration changing step-by-step along the radiating element symmetrically in respect to its longitudinal axis. The distance between the neighboring steps is considerably smaller than the working wavelength. The stripline antennas forming the array are connected with a selected period by one end to an excitation device representing a section of an unbalanced stripline. There are densely ranged stripline stubs on the side of the excitation device opposite to the stripline antennas.

This type of antenna provides for a wide working frequency band and has the maximum directed along the normal to the surface of the antenna. However, the application of a plurality of elements having a step form decreases the efficiency of the antenna due to losses related to spurious radiation and reflections on heterogeneities. Further, the use of identical radiating elements with consecutive feeding leads reduces the coefficient of utilization of the surface of the antenna. This is due to the drop of the amplitude of radiation along the length of the antenna.

Yet another microwave stripline antenna is disclosed in Russian patent 1730697-A1, issued on Apr. 30, 1992 to inventors common to the present invention. This patent, however, does not teach the use of a gradual junction or a radial bend. Instead, the Russian patent teaches an antenna that transfers high frequency energy from an excitation device to stripline antennas in a centralized path of the antenna through a transverse slot formed in the metallic base of the antenna. The transverse slot runs along the lateral axis of symmetry of the metallic base.

Therefore, it is an object of this invention to provide a means for manufacturing stripline antennas having high efficiency with large electrical dimensions.

It is another object of the present invention to provide a means for manufacturing a stripline antenna having a high amplification capability.

DISCLOSURE OF THE INVENTION

Other objects and advantages will be accomplished by the present invention which is a stripline antenna. The present invention serves to simplify the manufacturing technology of such antennas. At the same time, the antenna of the present invention has high efficiency with large electrical dimensions, providing for high amplification. The required directional pattern of an antenna is achieved using suitable radiating elements and the design of a suitable device for exciting the stripline antennas. The specific configuration of the radiating elements is calculated based upon these requirements.

The antenna of the present invention is composed of at least one stripline antenna, each of which represents an unbalanced stripline. Each of the antennas is defined by a series of radiating elements. The stripline antennas are integrated into an array with one end of each stripline antenna being galvanically in communication with a metallic common base. The required height above the base at which each of the stripline antennas is disposed is provided by a dielectric substrate interposed between the stripline antennas and the base.

Each radiating element of each stripline antenna defines a width which varies along it longitudinal axis. The configuration of each radiating element depends on the position of each element in the linear antenna, the length of the antenna, the required characteristics of its directional pattern and its input resistance.

The antenna of the present invention avoids the disadvantages of the prior art and provides an increased efficiency and amplification. The antenna of the present invention also enlarges the set of required characteristics of the directional pattern. Included of these required characteristics are the set level of the lateral radiation, the direction of the main maximum of the directional pattern and the width of the directional pattern.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
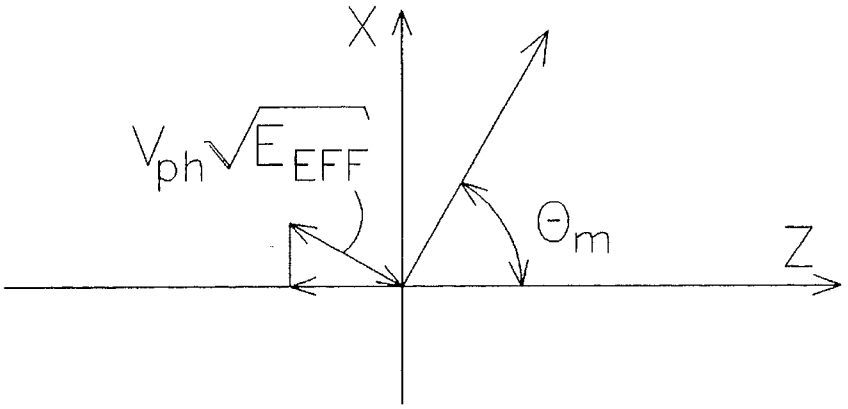
FIG. 1 is a graphic illustration of the relationship between the phase front and the maximum of radiation.

An antenna incorporating various features of the present invention is illustrated generally at 10 in the figures. The antenna 10 is designed for transmission of microwaves and is comprised of a plurality of stripline antennas 12, each of which represents an unbalanced stripline. Each of the stripline antennas 12 is composed of a plurality of radiating elements 14 formed in an end-to-end configuration. A stripline junction 16 is provided to connect each of the first ends 18 of the stripline antenna 12 to an excitation device 20.

Figure 2:
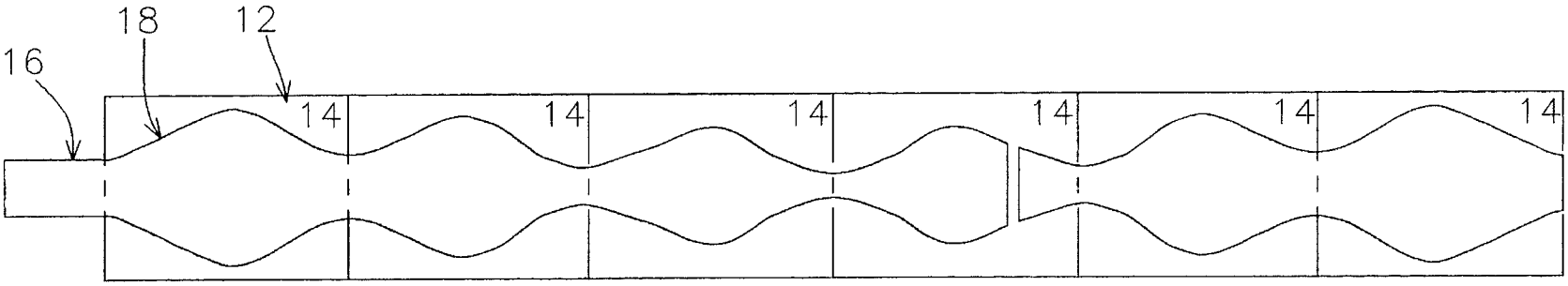
FIG. 2 is a top plan view of a stripline antenna comprising a plurality of radiating elements constructed in accordance with the present invention.

FIG. 2 most clearly illustrates a single stripline antenna 12 used in conjunction with the present invention. As shown, there is a plurality of individual radiating elements 14, the configuration of each depending upon its location along its length. The radiating elements 14 are joined in an end-to-end fashion. Of course, the radiating elements 14 comprising the stripline antenna 12 may be integrally formed. The stripline junction 16 is carried at one end 18 of the stripline antenna 12.

Figure 3:
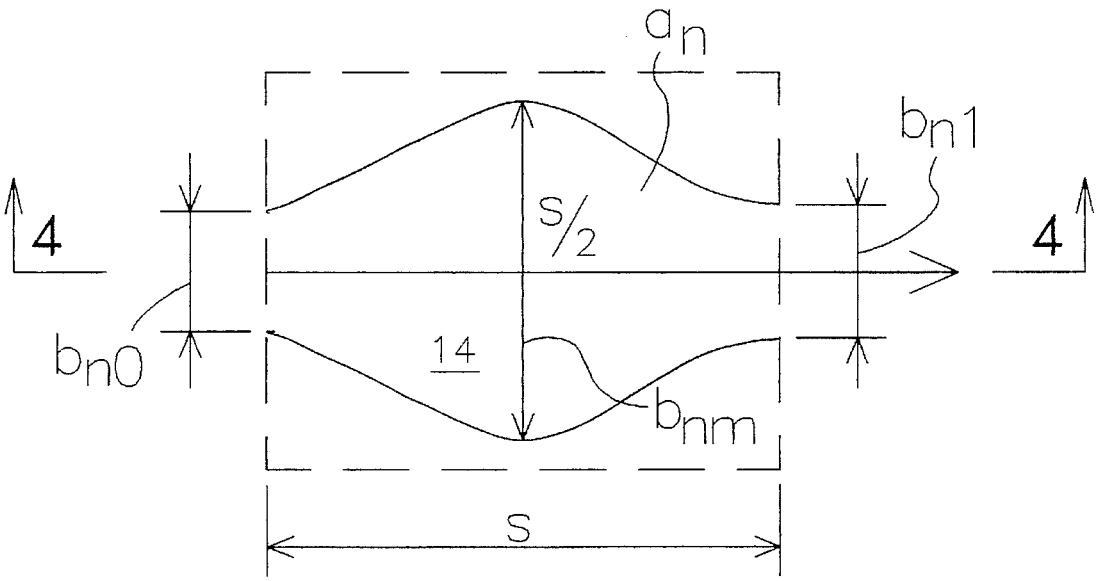
FIG. 3 is a top plan view of a single stripline radiating element of the present invention.
Figure 4:
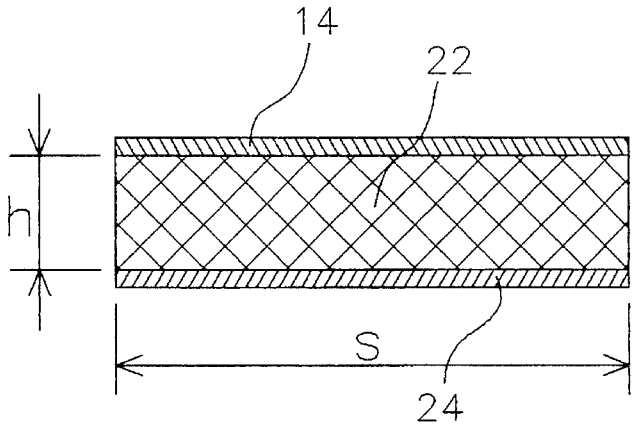
FIG. 4 is a side elevation view of the single stripline radiating element, in section, taken along 4—4 of FIG. 3.

FIGS. 3 and 4 best illustrate the configuration of a single radiating element 14 from a stripline antenna 12. FIG. 3 is a top plan view of the radiating element 14 and FIG. 4 is a side elevation, in section, of the radiating element 14. The radiating element 14 of the preferred embodiment represents a thin metallic conductor lying on the dielectric substrate 22 positioned on a metal base 24. The dielectric substrate 22 defines a thickness h possessing effective relative dielectric permeability $\in_{eff}$.

As illustrated, the width of the radiating element 14 varies with respect to its length. For illustration purposes, the radiating element 14 shown is the $n^{th}$ radiating element 14 in its stripline antenna 12. The width $a_n$ of the $n^{th}$ radiating element 14, where n is the location of interest, is changed symmetrically relative to its longitudinal axis in the following limits:

$$a_n = b_n(1 \pm \Delta)$$

where:

$b_n$ is the optimum width of the radiating element 14 in any arbitrary point, $0 \leqq \Delta \leqq 0.25$, $$b_n = \frac{b_{nm}}{2} + \frac{(b_{n0} + b_{ns})}{4} + \left[ b_{n0} - \frac{b_{nm}}{2} - \frac{(b_{n0} - b_{ns})}{4} + \left( \frac{(b_{ns} - b_{n0})}{s} \times Z \right) \right] \cos\beta Z$$

$b_{nm}$=maximum value of $b_n$, $b_{n0}$=value of $b_n$ where Z=0, $b_{ns}=b_{(n+1)s}$=value of $b_n$ where Z=s, $s=\lambda/[(1-\cos\Theta_m)(\in_{eff})^{1/2}]$, $\beta=2\pi/s$, $0 \leqq Z \leqq s$, n=number of the radiating element 14 in the linear stripline antenna 12, and $b_{nm}$, $b_{no}$, and $b_{ns}$ are chosen depending on required characteristics of the directional pattern and the input resistance of the antenna 12.

The particular configuration of each stripline antenna 12 will be dependent upon the length of the particular wave to be propagated.

Operation of the antenna 10 is accomplished by feeding a high frequency signal to each stripline antenna 12 through the respective stripline junctions 16. By feeding a high frequency signal to the stripline antennas 12, a wave is caused to propagate along the stripline antennas 12. The wave possesses the phase velocity:

$$V=C/(\in_{eff})^{1/2},$$

where C=the velocity of light in space.

Due to the configuration of each radiating element 14, a portion of electromagnetic energy is radiated. The residual portion of the electromagnetic energy is enters the input of the next radiating element 14. The portion of the energy radiated on $n^{th}$ element 14 is conditioned by the values which are selected. The selection of these values are dependant upon several factors, which chosen to provide required effective radiation, input resistance and characteristics of the directional pattern of the antenna 10.

The feeding wave propagates along the antenna 10 with phase velocity $V_{ph}$ and gradually transforms into the radiating wave possessing a certain carry-over of the phase. The phase carry-over is dependant upon the correlation of the wave length and the length of the radiating elements 14. The phase front, determined by the product of the phase velocity $V_{ph}$ and the effective relative dielectric permeability $\in_{eff}$, will condition the direction $\Theta_m$ of the maximum of radiation, where $$\Theta_m = \arccos\left(1 - \frac{\lambda}{s\sqrt{\epsilon_{eff}}}\right)\left(\frac{\lambda}{s\sqrt{\epsilon_{eff}}}\right)$$

where $\lambda$ is the length of the wave in space.

Figure 5:
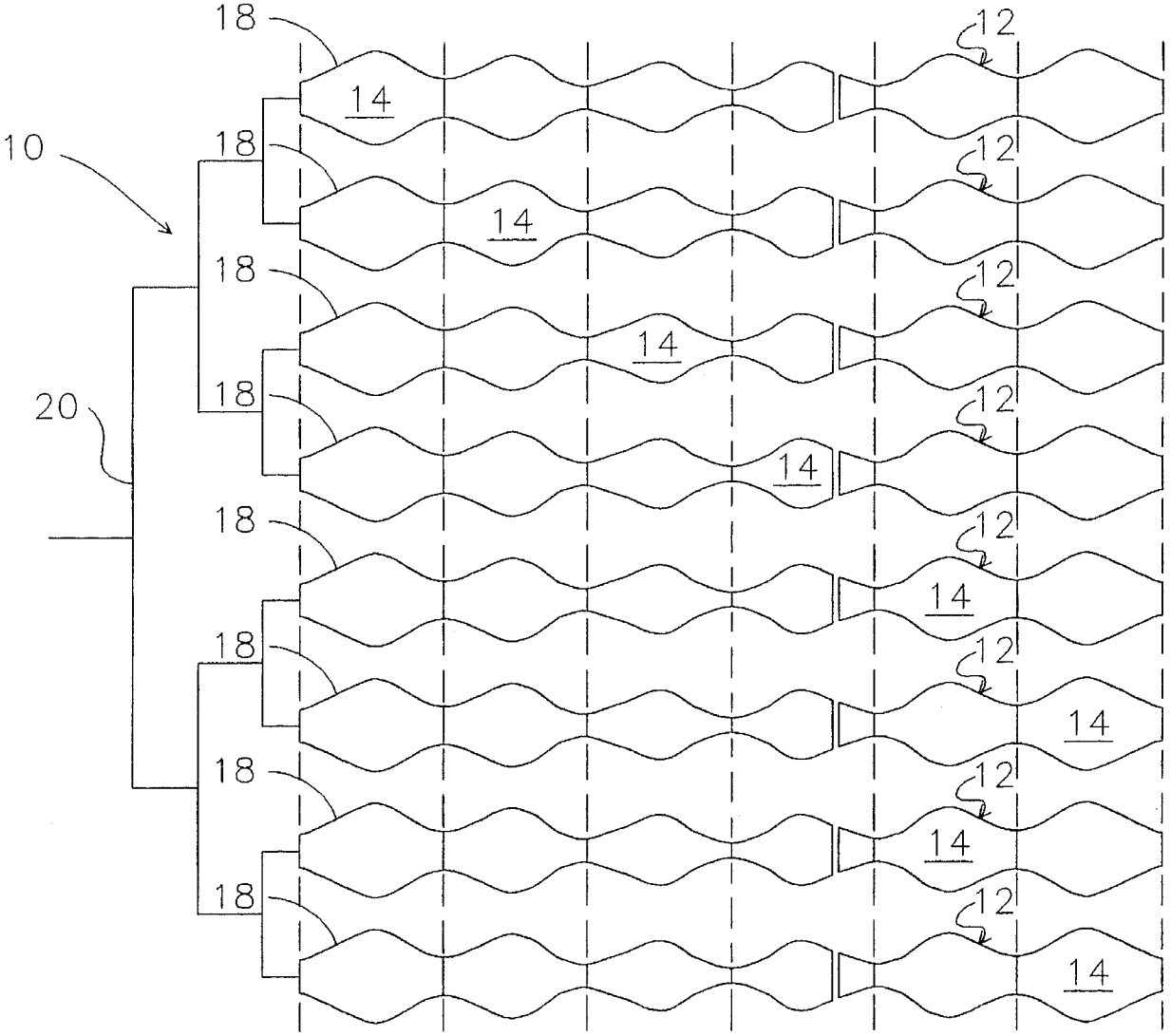
FIG. 5 is a schematic illustration of an antenna array composed of a plurality of stripline antennas as shown in FIG. 2.

To increase the gain of the antenna 10 and to narrow the directional pattern, the stripline antennas 12 are integrated into the array as shown in FIG. 5. The excitation of the antenna array is accomplished using an appropriate excitation device 20. As illustrated, the excitation device 20 may be a divider of output power on multiple waves.

Figure 6:
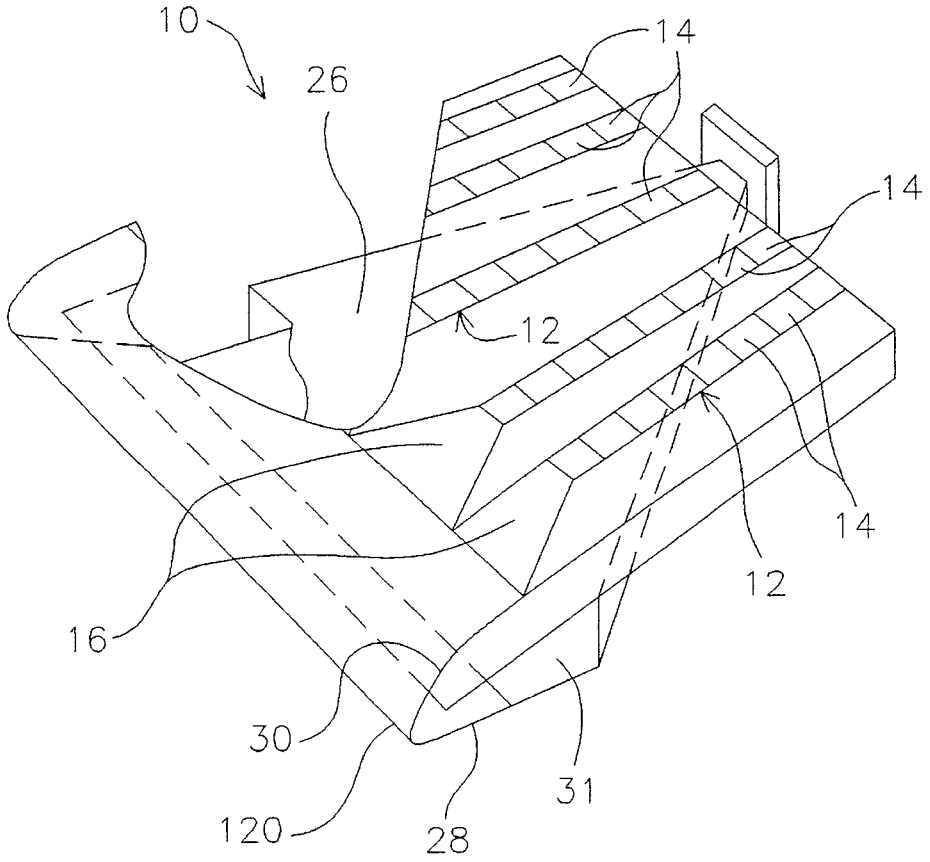
FIG. 6 is a perspective view of a portion of an antenna array as shown in FIG. 5 further illustrating a horn excitation device, each of the individual stripline radiating elements being generally represented by a square.
Figure 7:
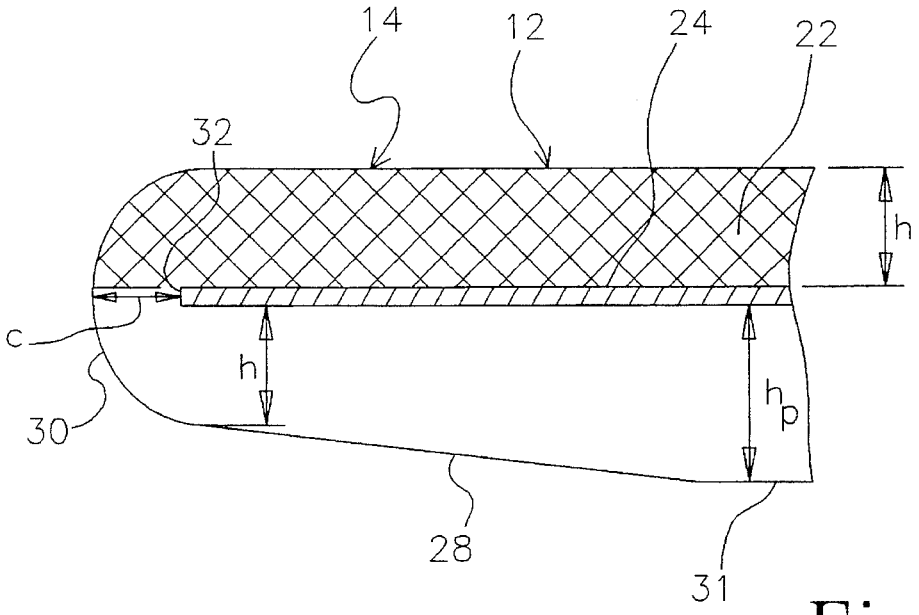
FIG. 7 is a side elevation view, in section of the antenna array and horn excitation device of FIG. 6.

FIG. 6 illustrates one preferred excitation, or feeding, device 120 for the excitation of the array of the stripline antennas 12. This type of feeding device 120 for the excitation of stripline antennas 12 decreases the losses in the antenna 10 caused by spurious radiation and reflections on heterogeneities and into a radial bend 30 of the feeding device 120. The stripline feeding device 120 of FIG. 6 consists of an H-plane sectorial horn 26, a gradual junction 28 from metallic lower wall 31 of the horn 26, and the radial bend 30. The common metallic base 24 of the stripline antennas 12 serves as the upper wall of the horn 26. A more detailed view of the gradual junction 28 and radial bend 30 is shown in FIG. 7.

A high frequency signal directed toward the input of the horn 26 transforms into a wave defining a cylindrical front. The wave propagates in the direction of the radial bend 30. The gradual junction 28 ensures the absence of reflections when the height of the horn 26 changes from $h_p$ to h, which corresponds to the height of the disposition of the linear stripline antenna 12 above the metallic base 24.

After the wave has travelled through the gradual junction 28, the wave is directed by the radial bend 30 to the input of the array of the stripline antennas 12 and excites the antenna sheet. The gradual junctions 28 serve to match input resistance of stripline antennas 12 with the output resistance of the radial bend 30. In the preferred embodiment, the distance from the forward edge 32 of the metal base to the inner surface of the radial bend 30 is chosen within the range of $h/2<c<h$. One factor having influence in choosing the value of c is related to the geometry of the radial bend 30. This is due to the fact that in a situation where the bend 30 is not radial, the electromagnetic field in various points of this unoptimum bend 30 has varied intensity which results in the reflection of the wave. The optimal choice of c allows the intensity of the field to be equalized and the matching of the antenna 10 to be improved.

Figure 8:
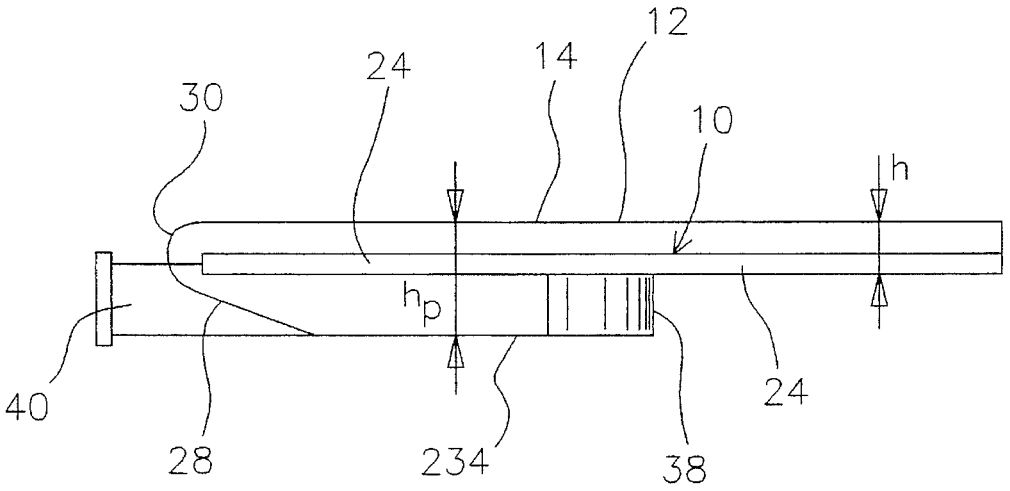
FIG. 8 is a side elevation view of an antenna array of the present invention with an excitation device comprising a radiation source as a segment of a rectangular waveguide and a correcting metal wall.
Figure 9:
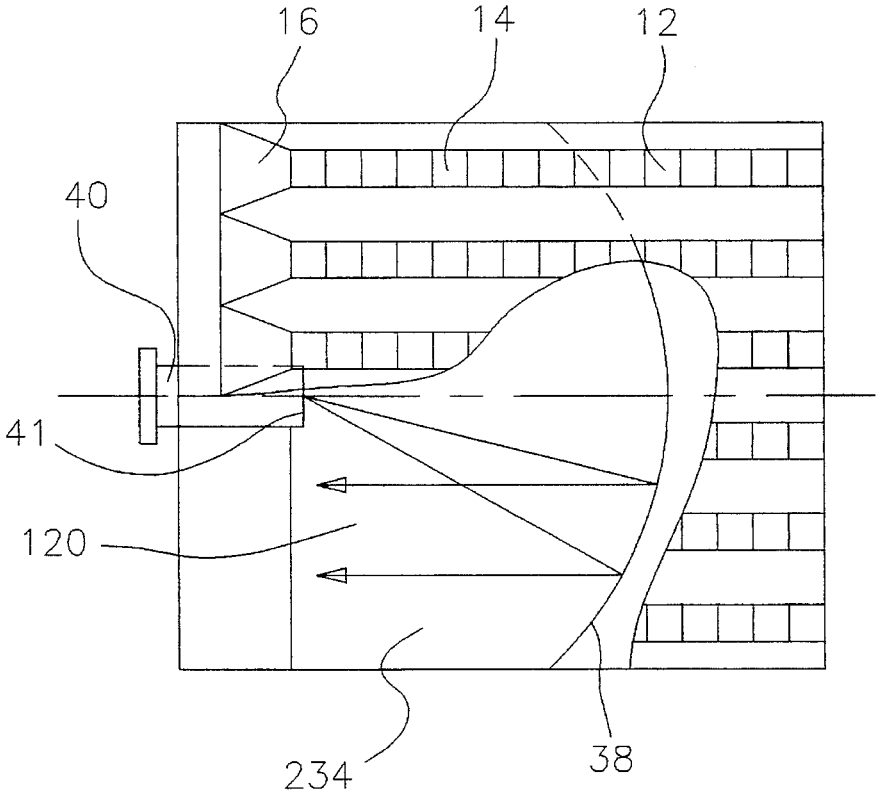
FIG. 9 is a schematic diagram of the excitation device shown in FIG. 8 wherein the waveguide is aligned with the screen and base.
Figure 10:
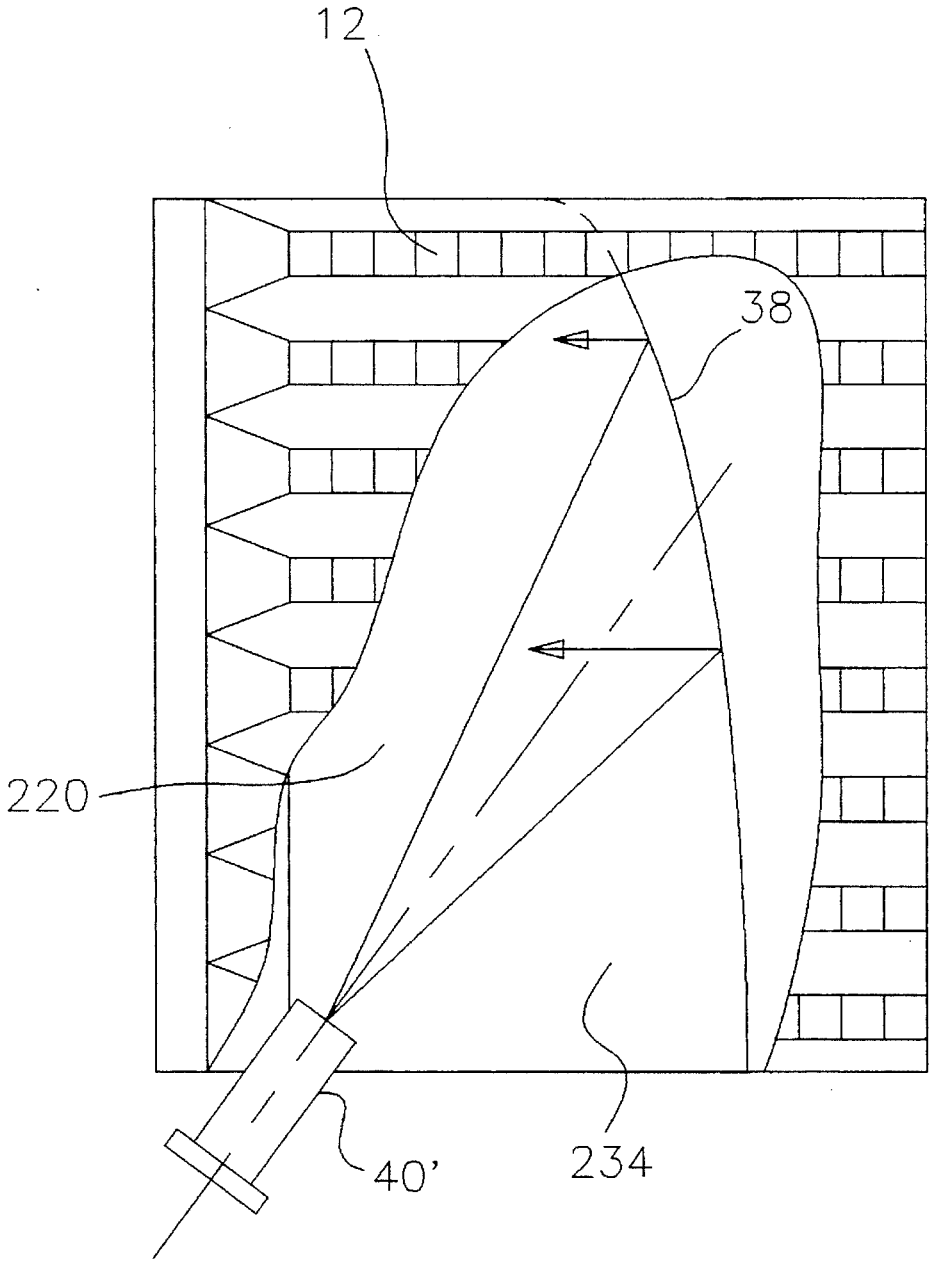
FIG. 10 is a schematic diagram of the excitation device shown in FIG. 8 wherein the waveguide is positioned at the edge of the base to prevent shielding of the reflected radiation waves.

When the lateral dimensions of the antenna 10 are relatively large, the carry-over of the phase on the edges of the horn excitation device 120 can considerably reduce the amplification of the antenna 10. To correct the phase front, causing the increasing of the efficiency of the antenna 10, the excitation device 220 as shown in FIGS. 8 and 9 may be used. The excitation or feeding device 220 illustrated in these figures is composed of a flat metal screen 234 and the base 24 of the antenna 10 galvanically connected one to another using metallic reflecting wall 38 which defining a selected curved configuration.

A high frequency signal is directed toward a rectangular waveguide 40. The open lead 41 of the waveguide 40 serves as a radiation source for the reflecting wall 38. The shape of the curved reflecting wall 38 of the preferred embodiment is calculated to cause the correction of the front of the wave coming from the radiation source 41. This front has the carry-over of the phase on its edges. The wave with the phase front required to provide the desired direction of the maximum of the radiation in the transverse plane of the antenna 10 is formed after correction. The waveguide 40 may be aligned with the screen 234 and base 24.

As seen from FIG. 9, the rectangular waveguide 40 may shield part of the mouth of the antenna 10, which reduces to some extent the coefficient of the utilization of the surface and forms the gap of amplitude distribution in the lateral plane. To avoid this situation, an external radiation source 40' may be used. To this extent, the external radiation source 40' may be positioned on the base 36 edge and directed to the center of correcting wall 38. In this case the wave reflected from the wall 38 is not shielded by waveguide 40.

When a narrow directional pattern of the radiation source is required, a small H-plane sectorial horn can be used.

From the foregoing description, it will be recognized by those skilled in the art that an antenna offering advantages over the prior art has been provided. Specifically, the antenna is comprised of an array of stripline antennas. Each stripline antenna represents a section of an unbalanced stripline and is comprised of a plurality of radiating elements of varying dimensions. The antenna of the present invention provides high efficiency and large electrical dimensions, which combine to provide high amplification of microwave signals.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

We claim:

1. A flat stripline antenna for propagating a microwave signal having a selected wavelength, said flat stripline antenna comprising:

at least one stripline antenna, each of said at least one stripline antenna being a section of an unbalanced stripline and consisting of a plurality of radiating elements consecutively connected one to another, each of said plurality of radiating elements being fabricated from a thin metallic conductor lying on a dielectrical substrate defining a height h, said dielectric substrate being disposed on a metallic base of said flat stripline antenna, each of said plurality of radiating elements defining a length s dependent upon a selected wavelength λ, a direction of maximum radiation $\Theta_m$ with respect to said flat stripline antenna, and a relative effective dielectric permeability $\in_{eff}$ of said dielectric substrate, each of said plurality of radiating elements defining a width $a_n$ variable along said length s, said width $a_n$ being dependent upon at least one characteristic of a directional pattern and an input resistance defined by said flat stripline antenna as defined by $$a_n=b_n(1\pm\Delta)$$

where:

$0\leqq\Delta\leqq0.25$, $b_n$ is an optimum width of said radiating element at an arbitrary point and is defined by $$b_n=\frac{b_{nm}}{2}+\frac{(b_{n0}+b_{ns})}{4}+\left[b_{n0}-\frac{b_{nm}}{2}-\frac{(b_{n0}-b_{ns})}{4}+\left(\frac{(b_{ns}-b_{n0})}{s}\times Z\right)\right]\cos\beta Z$$

where:

$b_{nm}$=maximum value of $b_n$, $b_{n0}$=value of $b_n$ where Z=0, $b_{ns}=b_{(n+1)s}$=value of $b_n$ where Z=s, $s=\lambda/[(1-\cos\Theta_m)(\in_{eff})^{1/2}]$, $\beta=2\pi/s$, $0\leqq Z\leqq s$, n=number of said radiating element, and where β, $b_{nm}$, $b_{n0}$ and $b_{ns}$ are selected depending upon required characteristics of said directional pattern and said input resistance of said flat stripline antenna.

2. The flat stripline antenna of claim 1 wherein said plurality of stripline antennas are oriented in parallel fashion one to another in a common plane, each of said plurality of stripline antennas sharing a common metal base.

3. The flat stripline antenna of claim 2 further comprising an excitation device, said excitation device being positioned under said metallic base of said flat stripline antenna.

4. The fiat stripline antenna of claim 3 wherein said excitation device includes an H-plane sectorial horn defining a height $h_p$, said H-plane sectoral horn consisting of first and second opposing metallic walls, said first metallic wall being defined by said metallic base, and said second metallic wall being galvanically connected to a gradual junction, said gradual junction being connected to a radial bend, a first end of each of said at least one stripline antenna being connected to said radial bend using a stripline junction, a second end of each of said at least one stripline antenna being galvanically connected to said metallic base of said flat stripline antenna, a forward edge of said metallic base being disposed a distance C from an inner surface of said radial bend within the range $h/2<C<h$.

5. The flat stripline antenna of claim 3 wherein said excitation device includes a radiation source, said radiation source being an open lead of a rectangular waveguide defining a height $h_p$, said waveguide being positioned on a longitudinal axis of symmetry of said metallic base of said flat stripline antenna, said waveguide including a first and a second pair of oppositely disposed walls, said first pair of oppositely disposed walls being positioned in alignment with said metallic base of said flat stripline antenna, said second pair of oppositely disposed walls being oriented parallel to said metallic base, a first wall of said second pair of oppositely disposed walls being galvanically connected to said metallic base of said flat stripline antenna, a second wall of said second pair of oppositely disposed walls being connected to a metallic screen oriented parallel to and spaced away from said metallic base a distance equal to said height $h_p$, an edge of said metallic screen opposite said waveguide being galvanically connected to said metallic base through a metallic reflection wall defining a curved configuration, a forward edge of said metallic screen being galvanically connected to a gradual junction, said gradual junction being connected to a radial bend, a first end of each of said at least one stripline antenna being connected to said radial bend using a stripline junction, a second end of each of said at least one stripline antenna being galvanically connected to said metallic base of said flat stripline antenna, a foward edge of said metallic base being disposed a distance C from an inner surface of said radial bend within the range $h/2<C<h$.

6. The flat stripline antenna of claim 5 wherein said radiation source is an H-plane sectorial horn.

7. The flat stripline antenna of claim 3 wherein said excitation device includes a radiation source, said radiation source being an open lead of a rectangular waveguide defining a height $h_p$, said waveguide being disposed at an outer edge of said metallic base of said flat stripline antenna, said waveguide consisting of a first and a second pair of oppositely disposed walls, said first pair of oppositely disposed walls being oriented at an acute angle relative to a longitudinal axis of symmetry of said metallic base of said flat stripline antenna, said second pair of oppositely disposed walls being oriented parallel to said metallic base of said flat stripline antenna, a first wall of said second pair of oppositely disposed walls being galvanically connected to said metallic base of said flat stripline antenna, a second wall of said second pair of oppositely disposed walls being connected to a metallic screen oriented parallel to and spaced away from said metallic base a distance equal to said height $h_p$, an edge of said metallic screen opposite said waveguide being galvanically connected to said metallic base through a metallic reflection wall defining a curved configuration, an axis of symmetry of said waveguide passing through a center of said metallic reflection wall, a forward edge of said metallic screen being galvanically connected to a gradual junction, said gradual junction being connected to a radial bend, a first end of each of said at least one stripline antenna being connected to said radial bend using a stripline junction, a second end of each of said at least one stripline antenna being galvanically connected to said metallic base of said flat stripline antenna, a foward edge of said metallic base being disposed a distance C from an inner surface of said radial bend within the range $h/2<C<h$.

8. The flat stripline antenna of claim 7 wherein said radiation source is an H-plane sectorial horn.

* * * * *